United States Patent [19]

Döhler et al.

[11] Patent Number: 4,629,550

[45] Date of Patent: Dec. 16, 1986

[54] CATALYTIC REFORMING OF GASOLINE FEEDSTOCKS

[75] Inventors: Werner Döhler, Marl-Polsum; Alfons Jankowski, Essen; Albert Fehrer, Voerde, all of Fed. Rep. of Germany

[73] Assignee: Veba Oel Entwicklungs-Gesellschaft mbH, Gelsenkirchen, Fed. Rep. of Germany

[21] Appl. No.: 776,785

[22] Filed: Sep. 17, 1985

[30] Foreign Application Priority Data

Sep. 22, 1984 [DE] Fed. Rep. of Germany ..... 3434919

[51] Int. Cl.[4] ..... C10G 35/04

[52] U.S. Cl. ..... 208/134; 208/60

[58] Field of Search ..... 208/8 LE, 10, 60, 134, 208/400

[56] References Cited

U.S. PATENT DOCUMENTS 3,533,938 10/1970 Leas ..... 208/60

*Primary Examiner*—Curtis R. Davis

*Attorney, Agent, or Firm*—Oblon, Fisher, Spivak, McClelland, & Maier

[57] ABSTRACT

Disclosed is a process for improving the yield and hydrogen production of catalytic reforming of gasoline derived from mineral oil sources, which at the same time improves knock resistance of the fuel derived. A positive amount of coal-derived feedstocks including refined light coal oil, light oil derived from coal mineral oil refining, gasoline derived from hydrocracking of coal mineral oil and the top product of coal hydrogenation are added to the conventional mineral oil-derived feedstock. An improvement in catalyst residence time is also achieved.

4 Claims, 2 Drawing Figures

CATALYTIC REFORMING OF GASOLINE FEEDSTOCKS

BACKGROUND OF THE INVENTION

1. Field of the Invention

This invention is concerned with catalytic reforming of gasoline feedstocks under elevated temperature and pressure. The traditional feedstocks of gasoline that may be reformed through this invention include straight run gasoline, gasoline and naphthas derived from catalytic or hydrocracking processes.

2. Background of the Prior Art

Catalytic reforming is one of the most important processes for the production of automobile fuels, particularly in light of the need for such fuels to exhibit increasing resistance to knocking, in order to meet the rising demands of high performance internal combustion engines which are currently being produced.

In the catalytic reforming process practiced under elevated pressure and temperature, a number of chemical reactions take place, including the dehydrogenation of naphthenes to aromatics, the isomerization of paraffins and naphthenes, and the dehydrocyclization of paraffins. Through hydrocracking, longer hydrocarbons are split into hydrocarbons of shorter molecular length, shorter molecule paraffins forming by the addition of hydrogen on the base olefinic particles. Due to these reactions, there is a net production of hydrogen as well as $C_1$ to $C_4$ hydrocarbon compounds. These reactions, taken cumulatively, lead to the increase in the resistance to knocking desired in the derived, reformed gasoline, which of course is characterized quantatively by octane rating indications. The knock strength of the fuel is measured under standardized conditions in test motors either by the motor method or the research method, both well known prior art methods and generally indicated as MOR (motor octane rating) or ROR (research octane rating).

The octane rating for n-heptane is by definition 0, that of iso-octane 100. Octane ratings of more than 100 are achieved by the addition of tetraethyl lead to iso-octane.

In view of environmental and pollution concerns, as well as modifications in the design and operation of internal combustion engines, it is desirable to limit to the greatest possible degree the addition of lead compounds as a method of raising the knock resistance of gasoline fuels, so that there continues to exist a demand for light fuels with extremely high knock resistance, in the absence of added lead compounds.

Accordingly, it is one object of the invention to provide a gasoline fuel of increased knock resistance or octane rating, in the absence of added lead compounds.

It is another object of this invention to limit the formation of $C_1$–$C_4$ hydrocarbon gases during the catalytic reforming process, to avoid the considerable loss of carbon occurring therefrom.

It is another object of this invention to provide a process which uses conventional catalytic reforming process parameters and apparatus, and yet provides an increased yield of desirable fluid products ($C_5$+ hydrocarbons) along with improved values of knock resistance in gasolines designed for use as automobile fuels. With respect to the state of the art of conventional catalytic reforming, used feedstocks and applied process parameters, it is referred, for example to Hydrocarbon Processing, Sept. 1980, p. 162.

SUMMARY OF THE INVENTION

These objects, as well as others, are achieved by adding to traditional catalytic reforming gasoline feedstocks an amount of additional feedstock, derived from coal sources. The addition of these coal-derived feedstocks, not only increases the knock resistance value of the derived gasoline product, but also increases the efficiency of the reforming process, particularly, in terms of improved yield of liquid products as well as hydrogen yield together with an improved holding period, or maintenance, of the catalyst.

BRIEF DESCRIPTION OF THE DRAWINGS

The FIGS. 1 and 2 of this application graphically illustrate the octane reading in $C_5$+ yield of products of the reforming process of the claimed invention, as compared with those of the prior art.

DETAILED DESCRIPTION OF THE INVENTION

Figure 1:
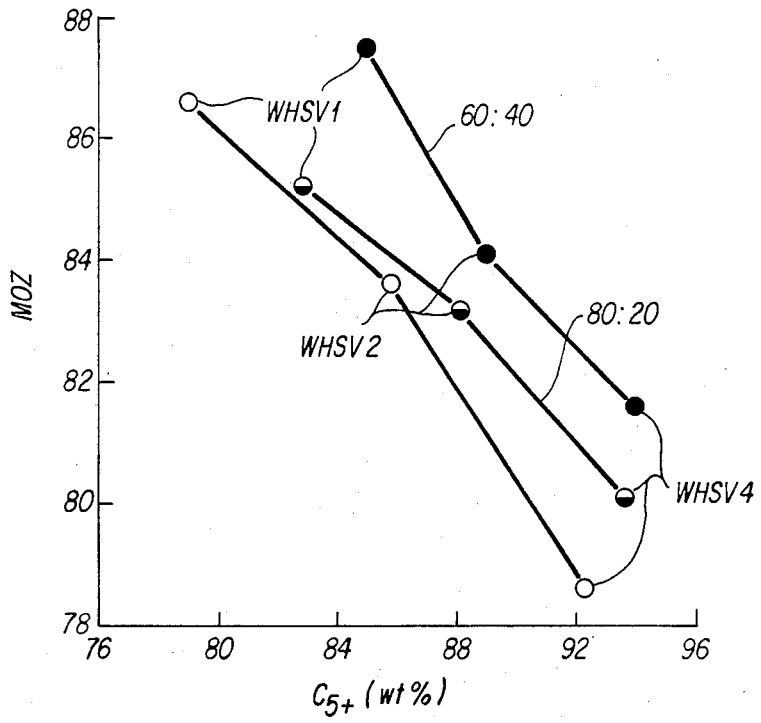

In general, catalytic reforming processes for gasoline feedstocks employ precious metal catalysts such as platinum, along with other metals, such as rhenium, which are deposited on carriers, such as highly purified alumina. The temperatures used lie at approximately 480°–550° C., and the pressures are approximately 8–30 bar, whereby a high partial hydrogen pressure works against deactivation of the catalyst, which might otherwise be caused by coke formation on the catalyst carrier. On the other hand, lower pressures facilitate increased yields of the desired reformed end product. Additionally, such processes are also accompanied by suitable procedures for regeneration of the catalyst, for example, by burning off carbon on the catalyst in swing reactors, or, additionally or alternatively, by continually draining part of the catalyst from the catalyst bed of the reforming vessel, and replacing it with new catalyst, such that the activity of the catalyst is sustained during the process. As is apparent, hydrogen production, as well as catalyst maintenance time, or residence time, are important figures. Additionally, the hydrogen production occurring during reforming is an important source for supplying the hydrogen demand existing in characteristic refineries for a variety of processes that are generally encountered.

Accordingly, it is clear that a process which maintains or improves hydrogen production, improves yield, and improves catalyst residence time will simultaneously satisfy all the above-described needs.

Those of skill in the art will be familiar with various conventional sources of gasoline feedstocks for the catalytic reforming process. These include, without limitation, mineral oil-derived straight run gasoline, gasoline or naphtha derived from various cracking processes as well as gasoline products derived from the EDS-coal hydrogenation process.

Results on the upgrading of coal liquids from the Exxon Donor Solvent coal liquefaction process by coal naphtha reforming are reported in Proc. Am. Pet. Inst., Refin. Dep. 1979, 373–379.

The inventors have discovered that by adding a limited amount of coal-derived feedstock to the feedstock stream, yield of the desired reformed $C_5$+ product is improved, hydrogen yield is improved, through a reduction of the generation of $C_1$–$C_4$ gases, and maintenance time of the catalyst is also improved. The coal-derived feeds include refined light coal oil, light oil derived from coal middle oil refining and gasoline derived from hydrocracking of coal middle oil and the top product of coal hydrogenation, provided that these feeds have reformer feed specification. In contrast to the typical mineral oil-derived gasoline feeds, which consist of up to 44% by weight of paraffins, and up to 41% by weight of monocyclo paraffins, up to 2% by weight dicyclo parrafins, and up to 13% of aromatics, the added coal-derived feeds of this invention generally can be distinguished by a lower paraffin content and yet higher monocyclo paraffin content.

Specifically the coal derived feeds according to the invention are derived from the hydrogenation of typical "Gasflammkohle" of the Ruhr area. This hydrogenation comprises slurrying a pulverized coal with a recycled coal derived middle and heavy oil fraction together with a hydrogenation gas at elevated temperature and elevated pressure into a liquid phase hydrogenation stage preferably in the presence of a catalyst; removing solids-containing residue from the discharge from said liquid phase hydrogenation stage, cooling the resulting residue-free volatile coal oil fraction from said discharge and removing the slurry oil fraction therefrom before feeding said volatile coal oil fraction to a gas phase hydrogenation stage which contains a conventional Ni-Mo- or Co-Mo-metal catalyst on a $Al_2O_3$ or $Al_2O_3$-$SiO_2$ support and refining or hydrotreating said coal oil fraction at elevated temperature and elevated pressure, from which the naphtha fraction to be used as reformer feed is separated. When this feedstock is added, preferably in range of up to about 40%, by weight, an improved knock resistance was produced in the yield, more yield of liquid products was derived, along with increased hydrogen yield, and increased catalyst residence time. The catalyst used was a commercially available platinum catalyst on alumina. However, the dehydrogenation of monocycloparaffins which would be the main reaction for coal-derived feeds in a reformer is an endothermic reaction. A feed made up predominantly of coal-derived naphtha could not be charged into a reformer designed for the usual mineral-derived napthas. For providing the necessary heat of reaction with admixtures of more than about 40% by weight of coal derived naphtha the boilers for heating up the feed would have to be increased accordingly.

It is even more preferred to add said coal-derived feed, wherein said feed is comprised of said mineral oil-derived feed and said coal-derived feed in a weight ratio of 80:20 to 60:40.

Figure 2:
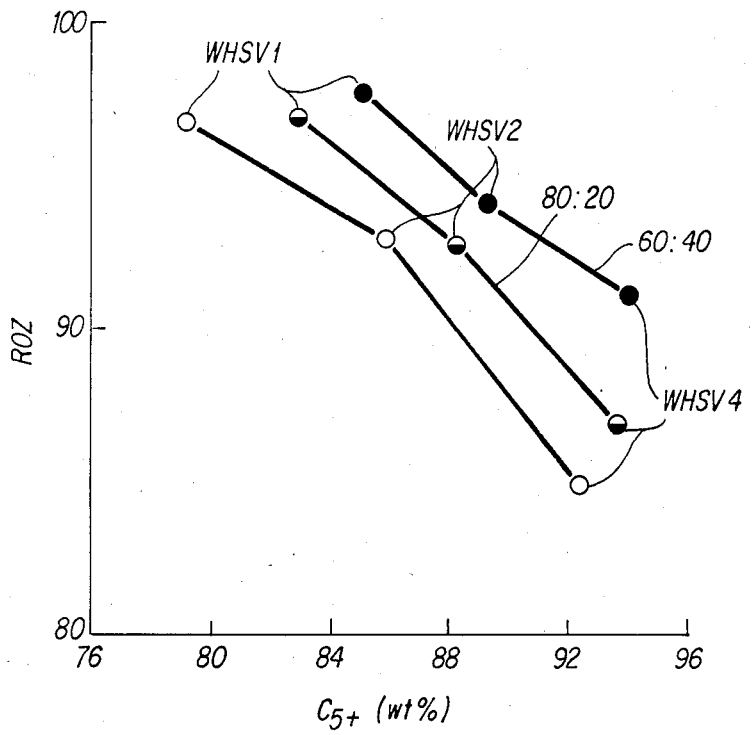

Turning to the FIGS. 1 and 2, each group of three graphs represents the products of the catalytic reforming of three different feeds.

On the ordinate of FIG. 1, the motor octane rating, on the ordinate of FIG. 2 the research octane rating, is plotted, and on the abscissa in each figure, the $C_{5+}$ yield, in percent by weight, is plotted.

The lowermost graph in each of the two figures represents (as a comparative value), a mineral oil-derived gasoline feed from usual refinery operation. The graph between the lowermost and the uppermost graph in each of the two figures represents a mixture of said gasoline feed with said coal-derived feed in a weight proportion of 80:20. The uppermost graph in each of FIGS. 1 and 2 represents a mixture of 60%, by weight, of said mineral oil-derived feed and 40% , by weight, of said coal-derived feed.

Each of the two sets of three graphs in FIGS. 1 and 2 represents corresponding values under the same reformer test conditions, in particular a pressure of 30 bar, a reactor temperature of 490° C. and constant contact (WHSV) with the catalyst.

Each of the three points making up a particular graph represents (for the particular mixture of the feed material) the space velocity (WHSV) in the range of 1 to 4 kg feed/kg contact . hour with the single values of 1, 2 or 4 respectively as indicated. The term contact in the given WHSV unit designates the catalyst on the carrier material.

It can be immediately seen from the figures that in the feeds which comprise mixtures of mineral oil and coal-derived feeds, higher octane ratings, and higher $C_{5+}$ yields, compared to mineral oil based reformer feeds, are achieved. There is also increased hydrogen production. Provided that the percentage of higher boiling dicycloparaffines in the admixed coal-derived feeds is limited by appropriate distillative cuts the maintenance time, or holding period, for which the catalyst employed in the reforming process maintains activity is even improved over mineral oil based reformer feeds.

For providing the same octane ratings as obtainable with mineral oil-derived feeds when operating the reforming process within the limits of admixtures of coal derived naphtha fractions according to the invention the severity of the process can be lowered to a considerable degree.

By way of specific example, a $C_{5+}$ yield of 79% by weight and research octane rating of just under 97 is achieved, as reflected in FIG. 2 submitted herewith, when the feed consists of mineral oil-derived, common gasoline. Given the same test conditions with an 80:20 mixture, a $C_{5+}$ yield of approximately of 83% by weight is achieved, and a value over 97 for the research octane rating is achieved.

Further improvements are achieved with a ratio of 60:40, mineral oil:carbon-derived feed, having a $C_{5+}$ yield of 85% by weight, and a research octane rating of approximately 98.

It should be noted that this advance in the catalytic reforming of gasoline feedstocks is achieved using conventional process parameters and apparatus, thus, making the modification quite simple and available to those currently involved in the catalytic reforming process.

What is claimed as new and desired to be secured by Letters Patent of the U.S. is:

1. In a process for the catalytic reforming of mineral oil-derived feedstocks comprising the cracking of said feedstocks under elevated temperature and pressure in the presence of a catalyst, wherein the improvement comprises adding to said feedstock to be reformed a product obtained from coal with reformer feed specification, selected from the group consisting of refined light coal oil, light oil derived from coal middle oil refining, gasoline derived from hydrocracking of coal hydrogenation processes in liquid phase at elevated temperature and elevated pressure in the presence of gaseous hydrogen, and introducing the mixture of said mineral oil-derived feedstock and product obtained from coal directly into the reformer.

2. The process of claim 1, wherein said feedstock is comprised of said mineral oil-derived feedstock and said coal-derived feedstock in a weight ratio of 80:20–60:40.

3. The process of claim 1, wherein said mineral oil-derived feedstock is selected from the group consisting of straight run gasoline, gasoline or naphtha derived from steam cracking or fluid catalytic cracking or hydrocracking processes and mixtures thereof.

4. The process of claim 1, wherein said coal-derived added feedstock has a composition that is lower in paraffin and higher in monocyclo paraffin content than said mineral oil-derived feedstock.

* * * * *